US010767849B2

(12) United States Patent
Cattoni

(10) Patent No.: US 10,767,849 B2
(45) Date of Patent: Sep. 8, 2020

(54) LED LUMINAIRE

(71) Applicant: Shat-R-Shield, Inc., Salisbury, NC (US)

(72) Inventor: Don Cattoni, Huntersville, NC (US)

(73) Assignee: Shat-R-Shield, Inc., Salisbury, NC (US)

( * ) Notice: Subject to any disclaimer, the term of this patent is extended or adjusted under 35 U.S.C. 154(b) by 0 days.

(21) Appl. No.: 15/494,100

(22) Filed: Apr. 21, 2017

(65) Prior Publication Data

US 2017/0307204 A1 Oct. 26, 2017

Related U.S. Application Data

(60) Provisional application No. 62/326,899, filed on Apr. 25, 2016.

(51) Int. Cl.

| | |
|---|---|
| ***F21V 29/89*** | (2015.01) |
| ***F21V 29/87*** | (2015.01) |
| ***F21S 8/00*** | (2006.01) |
| ***F21V 31/00*** | (2006.01) |
| ***F21V 29/76*** | (2015.01) |
| ***F21V 5/04*** | (2006.01) |
| ***F21V 23/00*** | (2015.01) |
| ***F21V 25/12*** | (2006.01) |

(Continued)

(52) U.S. Cl.

CPC ..... *F21V 29/89* (2015.01); *F21S 8/036* (2013.01); *F21V 5/04* (2013.01); *F21V 23/008* (2013.01); *F21V 25/12* (2013.01); *F21V 29/76* (2015.01); *F21V 29/87* (2015.01); *F21V 31/005* (2013.01); *F21V 3/00* (2013.01); *F21V 3/062* (2018.02); *F21Y 2115/10* (2016.08)

(58) Field of Classification Search

CPC . F21V 29/89; F21V 29/76; F21V 3/00; F21V 23/008; F21V 25/12; F21V 31/005

See application file for complete search history.

(56) References Cited

U.S. PATENT DOCUMENTS 7,287,347 B2 10/2007 Hasan
7,422,338 B2 9/2008 Kono et al.

(Continued)

FOREIGN PATENT DOCUMENTS

CN 202100984 U 1/2012
CN 104534371 A 4/2015

(Continued)

OTHER PUBLICATIONS

Howard Lighting HL03012RW HL0301 Series LED Slimline Thermoplastic Exit Sign Red Letters 120/277V AC Only; https://www.shineretrofits.com/howard-lighting-hl03012iw-hl0301-series-led-slimline-thermoplastic-exit-sign-red-letters-120-277v-ac-only.html; accessed Sep. 29, 2015.

(Continued)

*Primary Examiner* — Anabel Ton

(74) *Attorney, Agent, or Firm* — Nelson Mullins Riley & Scarborough LLP

(57) ABSTRACT

A light-emitting diode (LED) luminaire having corrosion resistant and vapor tight properties. The LED luminaire is suitable for use in hazardous locations or areas. The luminaire comprises a housing having external heat sink fins located thereon, a driver box mounted on top of the housing, and at least one light-emitting diode printed circuit board having a light-emitting diode within the housing.

15 Claims, 21 Drawing Sheets

(51) Int. Cl.

| | |
|---|---|
| *F21V 3/06* | (2018.01) |
| *F21Y 115/10* | (2016.01) |
| *F21V 3/00* | (2015.01) |

(56) References Cited

U.S. PATENT DOCUMENTS

| | | | | |
|---|---|---|---|---|
| 7,527,400 | B2 | 5/2009 | Yamamoto et al. | |
| 7,682,036 | B2 | 3/2010 | Reiff et al. | |
| 7,794,103 | B2 | 9/2010 | Hoover | |
| 8,029,162 | B2 | 10/2011 | Curran et al. | |
| 8,066,402 | B2 | 11/2011 | Klipstein | |
| 8,097,221 | B2 | 1/2012 | Incorvia et al. | |
| 8,197,098 | B2 | 6/2012 | Cook | |
| 8,376,602 | B2 | 2/2013 | Klipstein | |
| 8,403,526 | B2 | 3/2013 | Bayat et al. | |
| 8,459,831 | B2 | 6/2013 | Hsia et al. | |
| 8,579,462 | B2 | 11/2013 | VanDuinen et al. | |
| 8,672,506 | B2 | 3/2014 | Chen | |
| 8,721,110 | B2 | 5/2014 | Luo | |
| 8,764,238 | B2 | 7/2014 | Brukilacchio | |
| 8,789,978 | B2 * | 7/2014 | Tickner | F21S 8/02 362/294 |
| 8,876,333 | B1 | 11/2014 | Rashidi | |
| 8,898,940 | B1 | 12/2014 | Hasan | |
| 9,004,715 | B1 | 4/2015 | Litke et al. | |
| 9,080,745 | B2 | 7/2015 | Quaal et al. | |
| 9,097,412 | B1 | 8/2015 | Pinato | |
| 10,323,806 | B1 * | 6/2019 | Li | F21S 8/026 |
| 2002/0018344 | A1 * | 2/2002 | Sears, Jr. | H01R 29/00 362/265 |
| 2007/0030682 | A1 * | 2/2007 | Haugaard | F21S 8/06 362/264 |
| 2008/0304284 | A1 | 12/2008 | Guo et al. | |
| 2010/0014282 | A1 | 1/2010 | Danesh | |
| 2011/0075414 | A1 * | 3/2011 | Van De Ven | F21V 15/01 362/235 |
| 2011/0095690 | A1 | 4/2011 | Sagal | |
| 2011/0110086 | A1 | 5/2011 | Barnwell et al. | |
| 2011/0141728 | A1 | 6/2011 | Russello et al. | |
| 2011/0242828 | A1 | 10/2011 | Blincoe et al. | |
| 2012/0057348 | A1 | 3/2012 | Ruud et al. | |
| 2012/0250302 | A1 * | 10/2012 | Edwards | F21V 31/005 362/223 |
| 2012/0250321 | A1 * | 10/2012 | Blincoe | F21V 7/00 362/247 |
| 2012/0307501 | A1 | 12/2012 | Tankala et al. | |
| 2013/0057141 | A1 * | 3/2013 | Van De Ven | F21S 8/02 313/498 |
| 2013/0063937 | A1 | 3/2013 | Ahn et al. | |
| 2013/0069100 | A1 * | 3/2013 | Ahmed | F21V 15/01 257/99 |
| 2013/0094207 | A1 | 4/2013 | Negandhi et al. | |
| 2013/0286675 | A1 | 10/2013 | Hasan et al. | |
| 2013/0301266 | A1 | 11/2013 | Poissonnet et al. | |
| 2013/0314921 | A1 | 11/2013 | Chen | |
| 2013/0329434 | A1 * | 12/2013 | Packard | F21V 19/04 362/311.01 |
| 2014/0055997 | A1 | 2/2014 | Achammer et al. | |
| 2014/0098542 | A1 | 4/2014 | Zimmer et al. | |
| 2014/0160737 | A1 | 6/2014 | Strelchuk et al. | |
| 2014/0204570 | A1 | 7/2014 | Burmeister et al. | |
| 2014/0211474 | A1 | 7/2014 | Juan et al. | |
| 2014/0268830 | A1 | 9/2014 | Boyer et al. | |
| 2014/0347846 | A1 | 11/2014 | Ahn et al. | |
| 2015/0008549 | A1 | 1/2015 | Lee et al. | |
| 2015/0009676 | A1 * | 1/2015 | Danesh | H04R 17/00 362/364 |
| 2015/0085493 | A1 | 3/2015 | Sun et al. | |
| 2015/0092425 | A1 | 4/2015 | Thompson, III et al. | |
| 2015/0131294 | A1 | 5/2015 | Kuenzler et al. | |
| 2015/0176831 | A1 * | 6/2015 | Zhang | F21V 23/06 362/294 |
| 2015/0184808 | A1 | 7/2015 | Wang et al. | |
| 2015/0198310 | A1 | 7/2015 | Scarlata et al. | |
| 2015/0338077 | A1 | 11/2015 | Johnson | |
| 2015/0345770 | A1 | 12/2015 | Badley et al. | |
| 2016/0003464 | A1 | 1/2016 | Thomas et al. | |
| 2017/0045198 | A1 | 2/2017 | Ruiz De Apodaca Cardeñosa | |

FOREIGN PATENT DOCUMENTS

| | | | | |
|---|---|---|---|---|
| JP | 2014229430 | A | 12/2014 | |
| KR | 101201153 | B1 | 11/2012 | |
| WO | WO-2012175263 | A1 * | 12/2012 | F21V 29/004 |
| WO | 2013/124315 | A1 | 8/2013 | |
| WO | WO 2013/124315 | A1 | 8/2013 | |

OTHER PUBLICATIONS

Explosion Proof Lights; Larson Electronics; http://www.Jarsonelectronics.com/c-154-explosion-%5broof-lights.aspx?ph=&pclid=CMm44cLPnMgCFZWJaOodiZIDvQ ; accesed Sep. 29, 2015.

Explosionproof LED Globe; Energy Focus; http://www.energyfocusinc.com/wp-content/upload/EF_Mil-ExplosionGlobe.pdf ; 2014; Enery Focus, Inc.

Search Report and Written Opinion for corresponding PCT Patent Application No. PCT/US2017/029058; dated Jul. 6, 2017.

Feb. 5, 2020 Extended Search Report issued in European Patent Application No. 17790171.7.

* cited by examiner

LED LUMINAIRE

CROSS-REFERENCE TO RELATED APPLICATIONS

This claims priority from U.S. provisional application 62/326,899, filed Apr. 25, 2016, the contents of which is incorporated by reference in its entirety as though fully set forth herein.

FIELD OF THE INVENTION

The present invention relates to a luminaire, more particularly to a LED luminaire having vapor tight, waterproof, corrosion resistant, explosion-proof properties and suitable for use in hazardous locations.

BACKGROUND OF THE INVENTION

Lighting fixtures or luminaires are typically made from cast aluminum housings. Cast aluminum housings are used to dissipate heat that is generated by the light source and the power supply to energize that source. In the case of light-emitting diode (LED) lighting fixtures, it is extremely important and imperative that the junction temperature of the LED is maintained within the temperatures that are reported in LM80 data supplied by the LED manufacturer. If the temperature is not maintained and exceeds the allowable threshold, the life of the LED diminishes substantially, the color characteristics can change, and the lumen output decreases.

Existing cast aluminum fixtures are a good solution for dissipating heat because aluminum has very good thermal conductive properties that transfer the heat away from the LED light engine to maintain a desired junction temperature of the LED. While this aluminum housing is good at heat dissipation, it is not very good at corrosion resistance, has design limitations, and is heavy.

Poorly designed aluminum heat sink housings with the use of higher power LEDs can create many of these problems.

Corrosion is a significant issue and a problem for aluminum lighting fixtures. There have been advances made in coating aluminum fixtures to help against corrosion which include expensive multi-stage coatings but these are still susceptible to corrosion in environments that have salt and other types of chemicals and contaminants especially if the coating is chipped. These coatings and the aluminum fixture can easily deteriorate from both the outside and the inside of the fixture which does not have a protective coating. Another disadvantage of the aluminum LED fixture housing is material cost and the need to perform secondary operations for assembly.

Thus, there is a need for a luminaire that is corrosion resistant and yet solves the existing issues with aluminum LED fixtures including high cost and high weight.

Furthermore, fire and explosions are a major safety concern in manufacturing plants and other industrial facilities. There are regulatory bodies such as the Occupational Safety and Health Administration (OSHA) that have established systems that classify locations which exhibit potentially dangerous conditions to the degree of hazard presented. OSHA Publication 3073 defines a "hazardous location" as "areas where flammable liquids, gases or vapors or combustible dusts exist in sufficient quantities to produce an explosion or fire." Suitable equipment must be used in hazardous locations to protect against the explosive and flammable potential of these substances.

The National Electrical Code (NEC) and the Canadian Electrical Code (CEC) defines a "hazardous area" as "[a]n area where a potential hazard (e.g., a fire, an explosion, etc.) may exist under normal or abnormal conditions because of the presence of flammable gases or vapors, combustible dusts or ignitable fibers or flyings." Thus, there is a need for a corrosion resistant luminaire that is rated for use in hazardous locations and/or is rated as explosion proof according to UL classifications (Class 1, Division 1 and 2 and Class 2, Divisions 1 and 2).

There is also a need for a corrosion resistant luminaire that solves the above issues but also has increased ability to dissipate the heat from higher lumen output.

SUMMARY OF THE INVENTION

The present invention relates to a light-emitting diode (LED) luminaire. The LED luminaire is corrosion resistant. The LED luminaire is vapor tight. The LED luminaire is rated for hazardous locations.

In an embodiment of the invention, the luminaire comprises a housing having external heat sink fins located thereon, a driver box mounted on top of the housing, and at least one light-emitting diode printed circuit board having a light-emitting diode within the housing.

In an embodiment of the invention, the luminaire has outer surfaces that are corrosion resistant, is comprised of plastic construction and eliminates any external cooling fins to avoid containment of foreign particles that can harvest and grow bacteria.

In an embodiment of the invention, the luminaire comprises a housing having fins located within the housing, a driver box mounted within the housing, a heat sink having upward facing and downward facing heat sink fins within the housing, at least one light-emitting diode printed circuit board having a light-emitting diode within the housing, a lens within the housing, and a lens cover attached to the housing, the lens cover having lens cover fins interlocking with the downward facing heat sink fins of the heat sink. The upward facing heat sink fins are interlocking with the housing fins of the housing.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, which are not necessarily to scale, wherein.

DESCRIPTION OF THE PREFERRED EMBODIMENTS

The following description of the embodiments of the present invention is merely exemplary in nature and is in no way intended to limit the invention, its application, or uses. The present invention has broad potential application and utility, which is contemplated to be adaptable across a wide range of industries. The following description is provided herein solely by way of example for purposes of providing an enabling disclosure of the invention, but does not limit the scope or substance of the invention.

Figure 1:
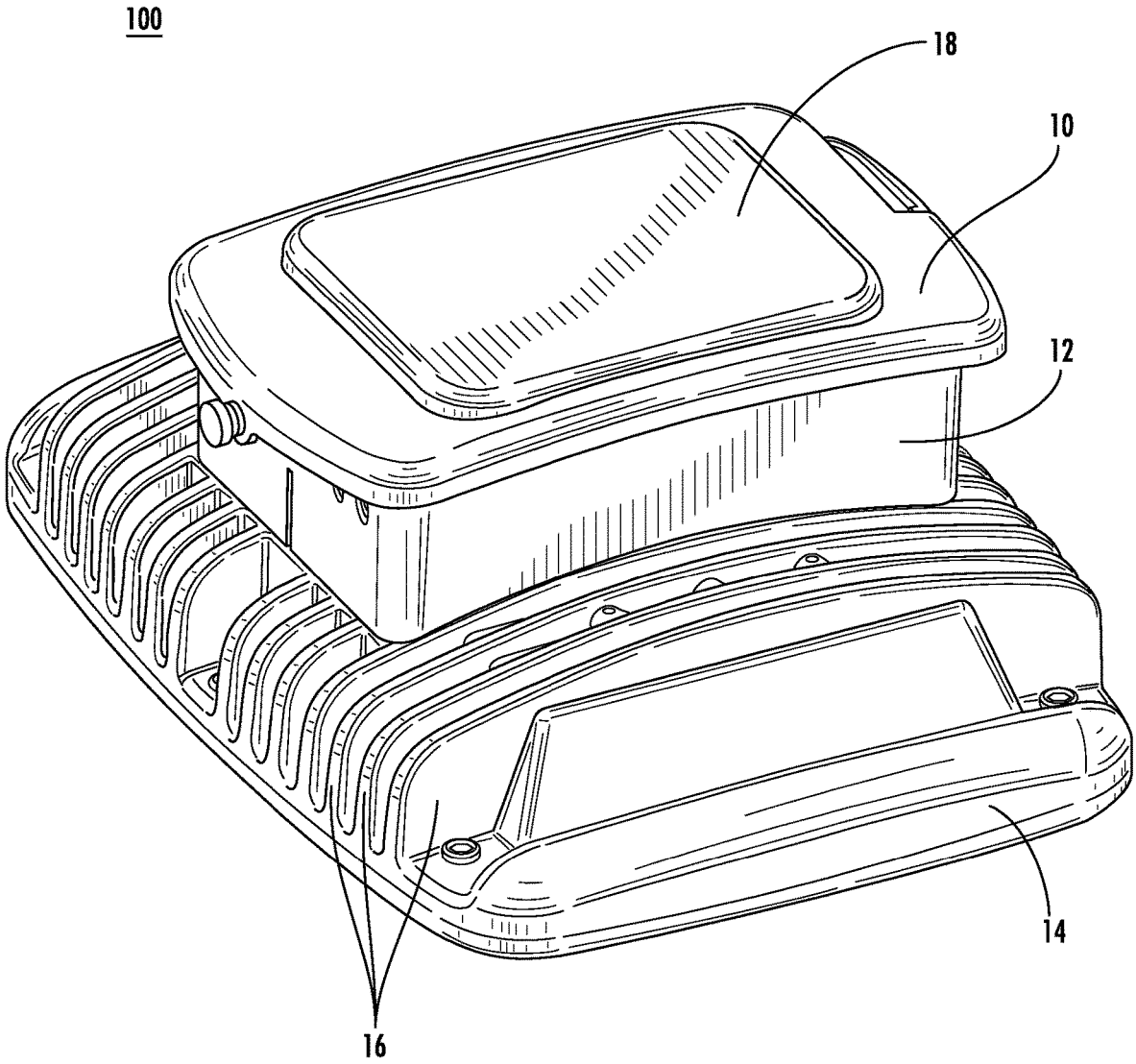
FIG. 1 is a perspective view of a luminaire in accordance with the present invention.

Referring to FIG. 1, a luminaire 100 is provided that dissipates heat from a light-emitting diode (LED) source, provides additional protection from corrosion, achieves a major reduction in weight and reduced cost, and is suitable for use in hazardous locations or areas, is waterproof and has explosion-proof variations.

As shown in FIG. 1, luminaire 100 generally comprises a driver box cover or lid 10, a driver box 12 having a driver therein, a housing 14 having multiple fins 16 on the exterior of housing 14, and a mounting plate 18 to mount luminaire 100. Preferably, housing 14 is in a form of a single molded housing. However, it is contemplated and within the scope of the present invention that housing 14 may be in a form of a multi-part molded housing.

Figure 2:
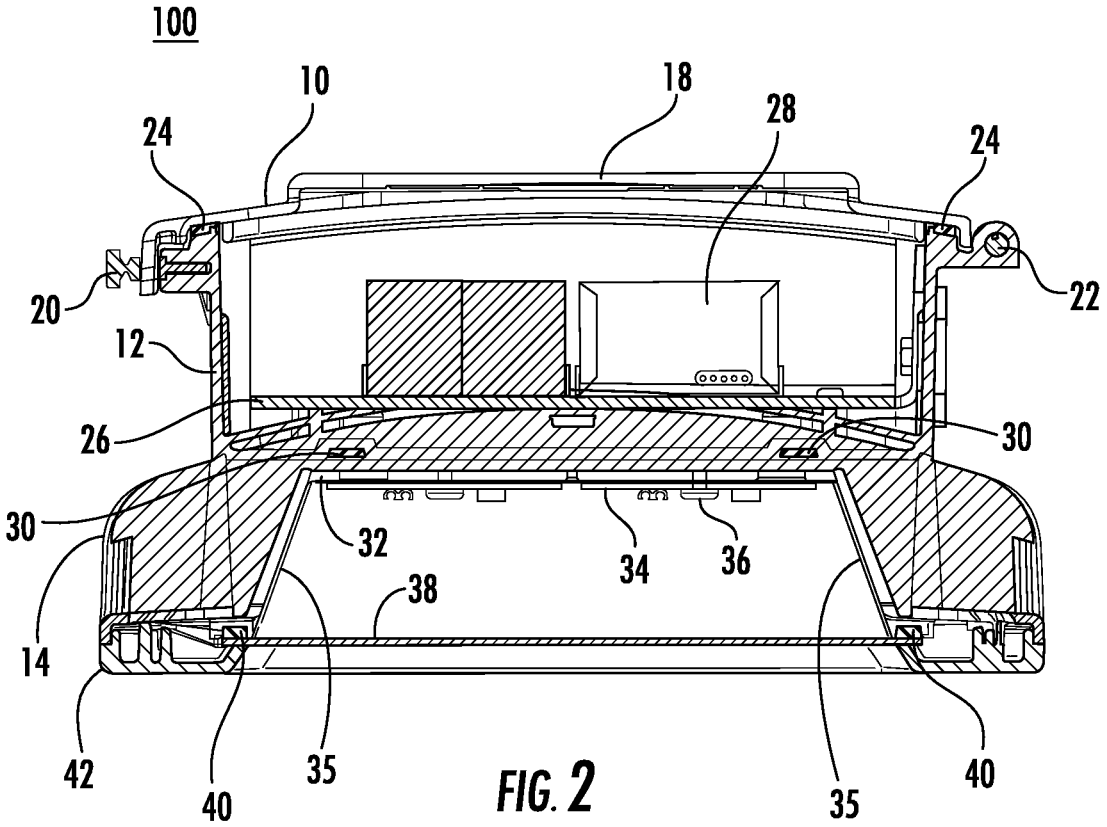
FIG. 2 is a cross-sectional view taken through the middle of luminaire of FIG. 1.

FIG. 2 is a cross-sectional view taken through the middle of luminaire of FIG. 1. As shown in FIG. 2, mounting plate 18 is located on top of driver box lid 10. Driver box lid 10 is attached to driver box 12 by a connecting piece such as a hinge, cam, pin, or combination thereof. As shown in FIG. 2, driver box lid 10 is attached to driver box 12 by a hinge pin 22 located on a side of driver box 12 for opening and closing of driver box lid 10. Any connecting piece may be used for connecting driver box lid 10 to driver box 12 such that driver box lid 10 may open and close. As shown in the figures, preferably the connecting piece is a hinge. On the opposing side of driver box lid 10 where driver box lid 10 is secured by hinge pin 22 is a fastening device such as thumbscrew 20 for securing closure of driver box lid 10. Although thumbscrew 20 is preferred, any number of securing mechanisms could be used to secure closure of driver box lid 10 to driver box 12. One or more gaskets 24 are present under driver box lid 10. The gaskets are placed between surfaces of driver box 12 and driver box lid 10. When the driver box lid is closed and secured with the fastening device, the gasket is allowed to compress and creates a waterproof seal between these two parts. Driver box 12 comprises at least one driver 28 located on a driver mounting plate 26. Preferably, driver mounting plate 26 is aluminum.

Housing 14 comprises one or more gaskets 30. Gasket 30 is placed between driver box 12 and housing 14 to seal openings that are inside of the gasket area. The openings allow for connecting wires from LED board 34 through to bottom of driver box 12 in order to make connections with the LED drivers for power. Gasket 30 eliminates intrusion of water, dust or contaminants from driver box 12.

Housing 14 comprises a LED board mounting plate 32 for lumen output of 10,000 lumen or higher. LED board mounting plate 32 helps to evenly transfer heat to the surface of housing 14. LED board mounting plate 32 is preferably aluminum. LED board mounting plate 32 preferably has at least one LED board 34 having a LED(s) 36 mounted thereon. Housing 14 comprises a lens 38 and lens cover 42 that covers the LED board 36 having lens 38 mounted thereon.

At least one gasket 40 is located near lens cover 42. Gasket 40 is placed between housing 14 and lens 38. Gasket 40 is compressed when lens cover 42 is tightened to housing 14. This compressed gasket seals lens 38 from allowing intrusion of water, dust or contaminants to enter into the LED cavity. The gaskets preferably have a minimum of 3/16 inch width of flat surface or contact area to meet UL844 Section 12.2, 12.3 Joints in Enclosures for Class II, Division 1, Groups E, F, and G locations.

As shown in FIG. 2, driver box 12 is mounted directly on top of housing 14. This allows for a more compact design. However, the position of driver box 12 on top of housing 14 creates a difficult task of dissipating heat away from LEDs 36 and driver 28 which is located in driver box 12. Another issue that luminaire 100 overcomes is that it meets the requirements for IP69K and NSF certification or is basically waterproof for industries that are in harsh environments, and/or use power washers to clean the equipment or for outdoor applications. Luminaire 100 does not have any unfilled space between driver box 12 and housing 14 so as to meet the NSF C-2 clean ability guidelines. Gasket 30 is used in between driver box 12 and housing 14 to make that joint waterproof and dustproof. By doing this, it restricts air flow movement and makes it difficult to transfer heat away from LEDs 36 and driver 28 to keep the LEDs 36 at a safe operating temperature. Exceeding a safe operating temperature can potentially void a warranty on the LEDs. Luminaire 100 overcomes this lack of airflow preferably by using aluminum heat spreading LED driver plates 26 and aluminum mounting plate 32 for the at least one LED printed circuit board 34.

Luminaire 100 has a lumen output that can exceed 7000 lumens. Luminaire 100 has a lumen output that can reach 10,000 plus (+) lumens. This increased lumen output requires higher, more powerful or more LEDs that generate more heat than a fixture having a lumen output of 3500 or 7000 lumens. Luminaire 100 is specifically designed to compensate for the additional heat generated from the higher power LEDs and the fact that driver box 12 is sealed to housing 14 which holds LEDs 36. Thus, a higher performance thermally conductive material is used.

For a 10,000 plus lumen version of luminaire 100, at least 15 watt per meter Kelvin in-plane for the level of thermal conductive material is preferred to keep the electronic components within safe operating temperatures. To dissipate the heat from the LEDs on a higher lumen output 10,000 version, LEDs are mounted on an aluminum heat dissipation plate and then mounted into the thermally conductive housing. This allows for better transfer of heat from the LED boards to the thermally conductive housing. A thermal interface material is used to eliminate air gaps between the LED board and the thermally conductive housing to transfer heat.

Examples of commercially available thermally conductive plastics or resins are Stanyl TC 551, Sabic LNP Konduit Compound OX10324, Bayer/Covestro Makrolon 8030. These plastics have a Watts per meter Kelvin rating in a range of 13 W/mK to 23 W/mK in plane.

Luminaire 100 is a multiple use fixture for many different applications. Luminaire 100, unlike a luminaire comprising other thermally conductive polymers such as PPS, is to be classified for UL Hazardous Locations. The assembly joints have gaskets that have a minimum of 3/16 inch wide of flat contact area. The gaskets preferably comprise polytetrafluoroethylene or a material having similar characteristics. The gaskets may be comprised of plant-fiber sheet packing material if the surface temperature to which the gasket is exposed does not exceed 90° C. (194° F.). The gaskets may be attached by an adhesive or cement.

Lens 38 may comprise a polycarbonate, high impact acrylic or safety glass. Preferably, lens 38 is comprised of a more impact and heat resistant material than a polystyrene, for example. Lens 38 in conjunction with lens cover 42 form a lens assembly. In a preferred aspect of the invention, the lens assembly is waterproof. The lens assembly comprises a gasket 40 adjacent to lens 38 of the lens assembly.

Luminaire 100 is comprised primarily of plastic components and eliminates most of the traditional metal such as all of the exterior metal (with the exception of any metal screws) in existing power LED lighting fixtures. As shown in FIG. 2, luminaire preferably comprises aluminum mounting plates for the LED boards and the driver. Luminaire 100 preferably has lumen output of 5000 lumen and 10,000 lumen, respectively. However, any metal parts in driver box 12 are completely sealed from the elements. Luminaire 100 is corrosion resistant and eliminates the need for a secondary coating as is required with traditional cast aluminum LED housings to help protect from corrosion. Luminaire 100 is suitable to be used in harsh environments which also includes raised ambient temperature up to 40 or 50 degrees Celsius and extreme cold temperatures −40° C. The Watts per meter Kelvin needed (in the properties of thermally conductive resin used to mold the housing) to maintain an acceptable junction temperature for the LEDs is typically in a range of 10 W/mK to 25 W/mK in plane.

As a feature of the invention, housing 14 is thermally conductive and is comprised of a thermally conductive plastic resin or a combination of thermally conductive plastic resins. A thermally conductive plastic resin comprises a base resin material. The base resin material is selected from any number of different plastic resins. Examples of such resins include, but are not limited to, polyvinyl chloride (PVC), polyphenylene sulfide, polyamide (nylon), polycarbonate, Acrylonitrile-Butadiene-Styrene (ABS), Liquid Crystalline Polymer (LCP), theinioplastic elastomer, polyphthalamide, polybutylene terephthalate, and polyaryletherketone, and a combination thereof. The different types of resins offer different physical properties. To achieve thermal conductivity, to the base resin is added at least one thermally conductive filler such as graphite or boron nitride to change the thermal properties of the resin. Adding a thermally conductive filler(s) into the base resin can have a dramatic effect on brittleness and impact strength. Nano-particles can also be added to the compound to increase thermal conductivity and strength properties.

The use of such resins eliminates the need for a secondary coating and provides corrosion resistance. This feature is especially important for harsh environments that have a salt environment such as coastal area and marine applications. Many industrial and commercial environments such as food processing, use power washers and different cleaning chemicals to wash down the processing area which includes the lighting fixtures. The resin selected protects against corrosive chemical cleaning agents, corrosive salt, and ocean and harsh environments, among others.

In a preferred aspect of the invention, a thermally conductive polycarbonate is used as a thermally conductive plastic resin for housing 14. A criteria for selection of a thermally conductive plastic resin is that it is of sufficient thermal conductivity to transfer the heat away from the LED light source. Thermal conductivity is the rate at which heat passes through a material, measured in Watts per square meter of surface area for a temperature gradient of one Kelvin for every meter thickness. This is expressed as W/mK.

The thermally conductive material needs to have the proper amount of W/mK to transfer the heat away from the LED.

For the luminaire, the thermal conductivity for the thermally conductive plastic resin is measured in two different directions. The first direction being in-plane which transfers the heat in a horizontal orientation and the second direction being through plane which transfers the heat in a vertical orientation. The thermal conductivity for the thermally conductive plastic resin in either direction is in a range of at least 1 W/mK, preferably in a range of 1 W/mK to 40 W/mK, more preferably in a range of 3 W/mK to 20 W/mK. This can vary from 1 W/mK in-plane up to 20 W/mK or more. Housing has external heat sink fins 16 to increase the surface area and transfer the heat to allow for natural convection to assist in heat dissipation.

Another advantage of using thermally conductive plastic resins is that they have lower coefficients of thermal expansion (CTE) than aluminum and can reduce the stress that is transferred to the assembly of components that comprise the luminaire, such as the gaskets. The use of thermally conductive plastic also eliminates excess weight of the fixture which helps facilitate installation. Luminaire 100 is up to 50% lighter as compared to aluminum fixtures.

Figure 3A:
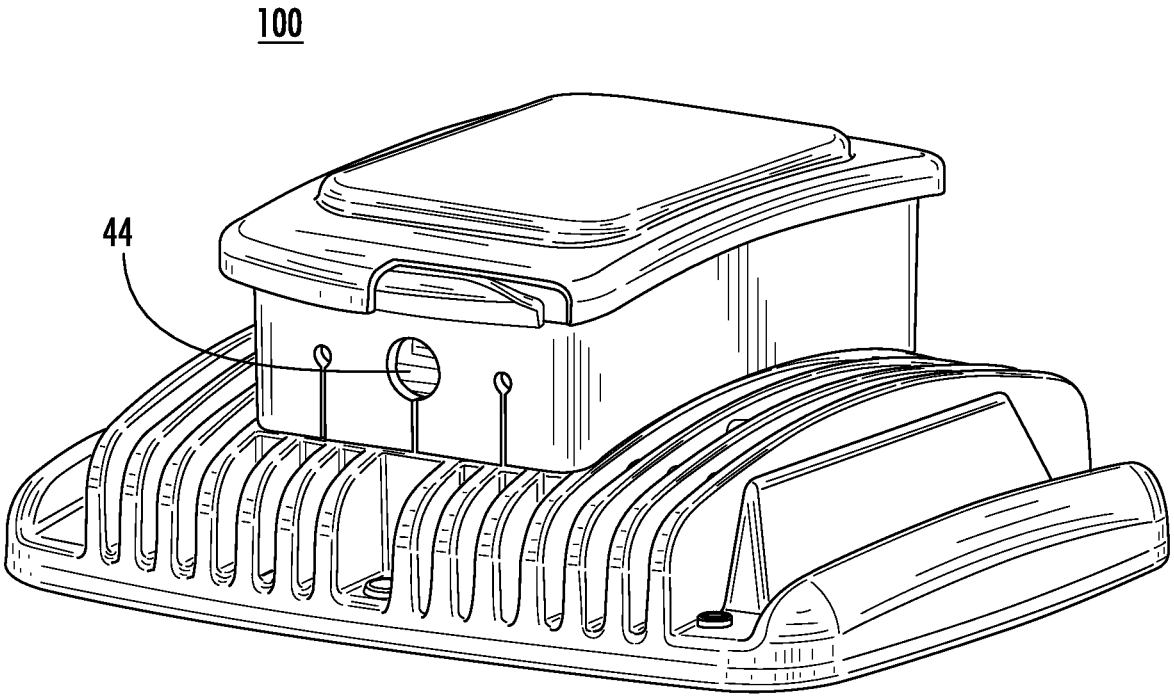
FIG. 3A is a perspective view of luminaire of FIG. 1 with optional hole.

FIG. 3A is a perspective view of luminaire of FIG. 1 with an optional hole 44 for mounting of an occupancy sensor (not shown) or a power connection (not shown).

Luminaire 100 is compact for its amount of lumen output. The weight of luminaire 100 is in a range of 5 to 8 pounds. An example size of a compact luminaire is a luminaire up to about 13 inches wide×10 inches deep×7 inches high producing a range of lumens up to 11,000 or more depending on the length of hours for a specified warranty (meaning for a specified number of hours it is possible to get approximately 11,000 lumens but although can get more by putting more current into the LEDs that diminishes the amount of hours the LEDs last because the LEDs get hotter).

In order to accomplish being compact for the amount of lumen output referenced above and referring to FIG. 2, a power supply (AC to DC) is mounted within driver box 12 that is located on top of housing 14. This mounting location has an adverse effect on heat dissipation because there is heat to dissipate under driver box 12 where LED board 34 is located. Therefore, heat dissipation is taken into account when determining the amount of W/mK in selection of thermally conductive plastic for housing 14. To dissipate heat away from the LED board and maintain an allowable heat temperature for the driver, LED boards 34 are mounted to aluminum mounting plate 32. A thermal interface material may be used in-between the LED boards and the LED mounting plate. The mounting plate takes the heat from the LED boards and evenly distributes the heat to the mating surface of housing 14. Thermal interface material may be used between LED mounting plate 32 and housing 14. High reflectance material (white) 35 is preferably used to increase lumen output of the luminaire. For example, such material can increase the lumen output of the luminaire by 20%

Driver box 12 comprising power supply is preferably not made of a thermally conductive material so as to pass the UL requirements to have a UL5VA flame rating and the −30° C. impact test required for outdoor applications. Preferably, the plastic for the housing and/or the driver box is corrosion resistant. Preferably, driver box 12 is comprised of a non-thermally conductive polycarbonate, but is not limited to such material, so as to meet UL1598, Section 5.7.1.2 to have a minimum 5Va flame rating.

Another unique feature of luminaire 100 is that it has an IP69 rating which does not allow for heat vents in housing 100 to dissipate heat. The addition of heat vents would allow water ingress into the fixture.

Luminaire 100 has gaskets on all mating surfaces (see FIGS. 2 and 5) to prevent the ingress of dust or water from high pressure spray. Luminaire 100 meets regulatory codes and guidelines for outdoor and marine applications. Luminaire 100 comprises different plastic resins for different components. Luminaire 100 meets the following certifications including, but not limited to, UL 1598, 1598a (Marine and Outdoor applications), wet locations, UL 844 Standard for Luminaires for use in Hazardous (Classified) Locations—UL 844 Class 1 Division 2 and Class 2 Division 1 and 2, USDA, IP69K, NSF C-2, and NEMA 4, 4x, 5.

Figure 3B:
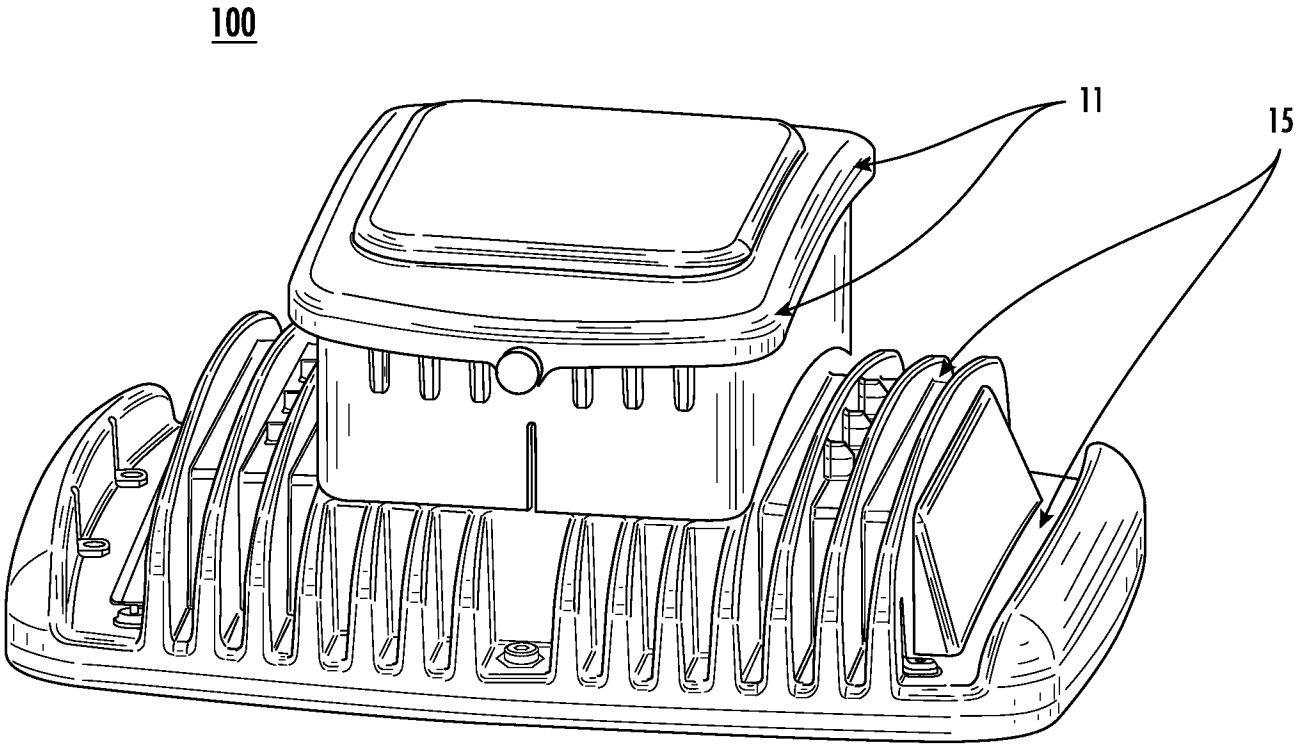
FIG. 3B is a perspective view illustrating angled top surfaces of the luminaire of FIG. 1.

FIG. 3B is a perspective view illustrating angled top surfaces of luminaire 100 of FIG. 1. Luminaire 100 has, for example, angled top surfaces 11, 15 for water to run-off. This feature is designed to overcome the issue that there can be no water to collect and stay on the fixture so as to avoid bacteria growth. As shown in FIG. 3B, driver box lid 10 has one or more angled sides and edges 11. Housing 14 has one or more angled top surfaces 15 as it is undesirable to have water collect and stay on the fixture and have bacteria grow.

Luminaire 100 is designed to be used as an area light, wall pack light or a flood fight. Luminaire 100 can be mounted in a variety of ways. Examples include, but are not limited to, surface, trunnion surface, pendant, wall pack, adjustable wall pack, pole, and flood light. For example, luminaire 100 can be for use on a pole with wind loads.

Figure 4:
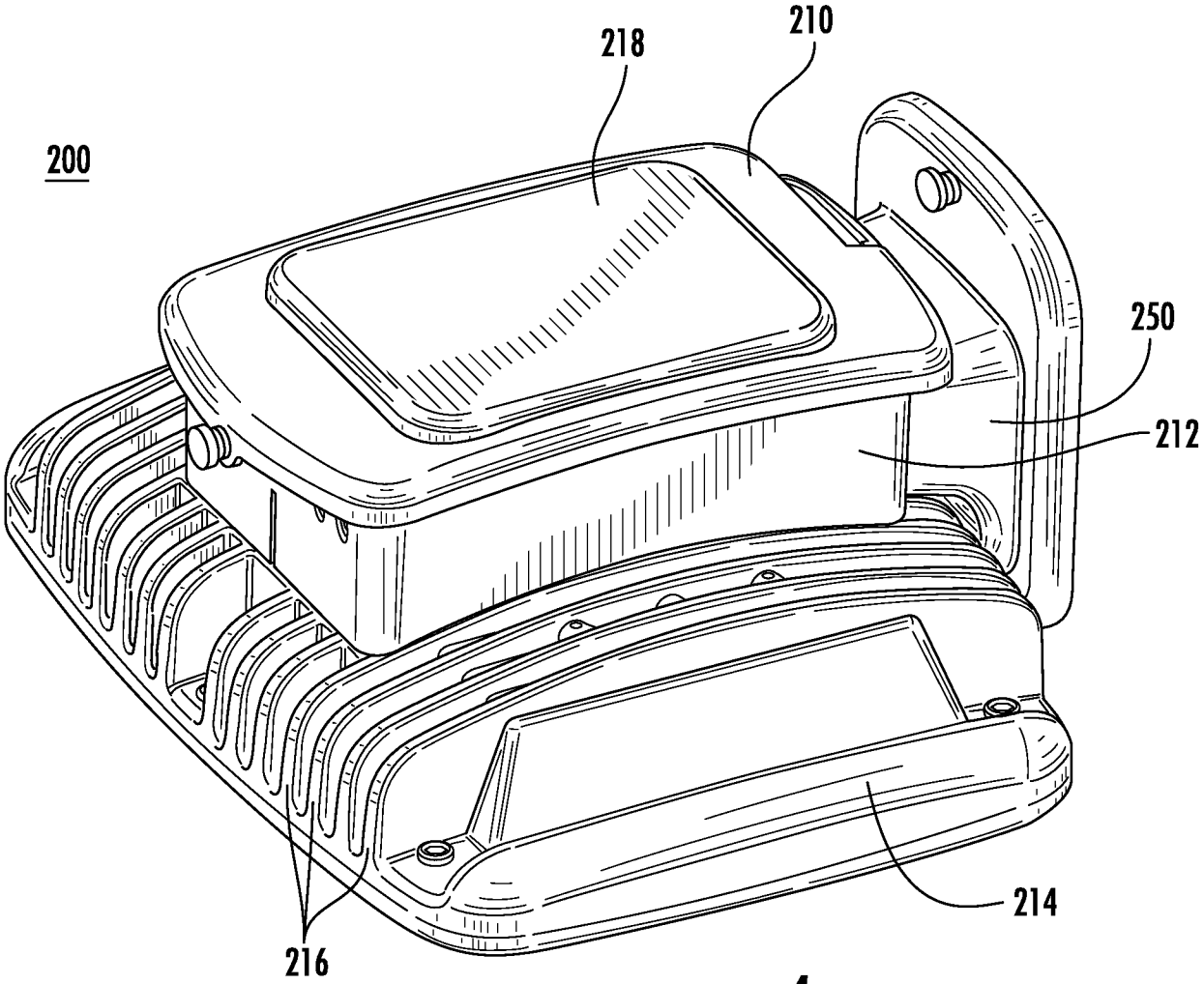
FIG. 4 is a perspective view of a luminaire with a wall pack in accordance with the present invention.
Figure 5:
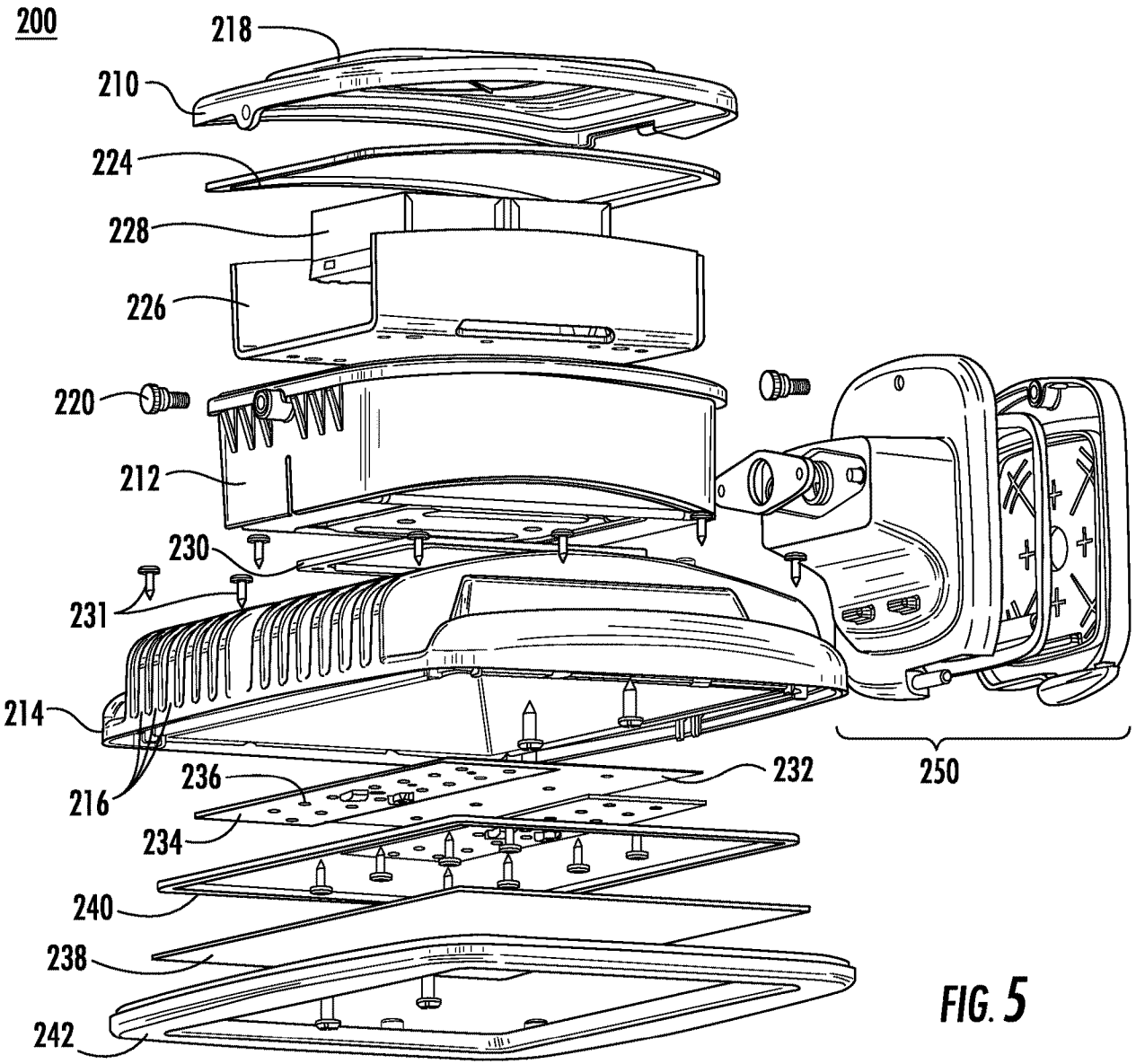
FIG. 5 is an exploded view of the luminaire with the wall pack of FIG. 4.

In an embodiment of the invention, FIG. 4 is a perspective view of a luminaire 200 with a wall pack assembly 250 in accordance with the present invention. FIG. 5 is an exploded view of luminaire 200 with wall pack assembly 250 of FIG. 4.

As shown in FIG. 4, luminaire 200 generally comprises a driver box lid 210, a driver box 212, a housing 214, external heat sink fins 216, a mounting plate 218, and a wall pack assembly 250.

Referring to the exploded view of luminaire 200 in FIG. 5, luminaire 200 generally comprises mounting plate 218, driver box lid 210, gasket 224, drivers 228, driver mounting plate 226, screw 220, driver box 212, gasket 230, screws 231, housing 214, external heat sink fins 216, printed circuit board (pcb) mounting board (preferably aluminum) 232, LED printed circuit board 234, LED 236, gasket 240, lens 238, lens cover 242, and wall pack assembly 250. Mounting plate 218 is preferably flat to facilitate surface mounting and may be a single molded piece with driver box lid 210.

Figure 6:
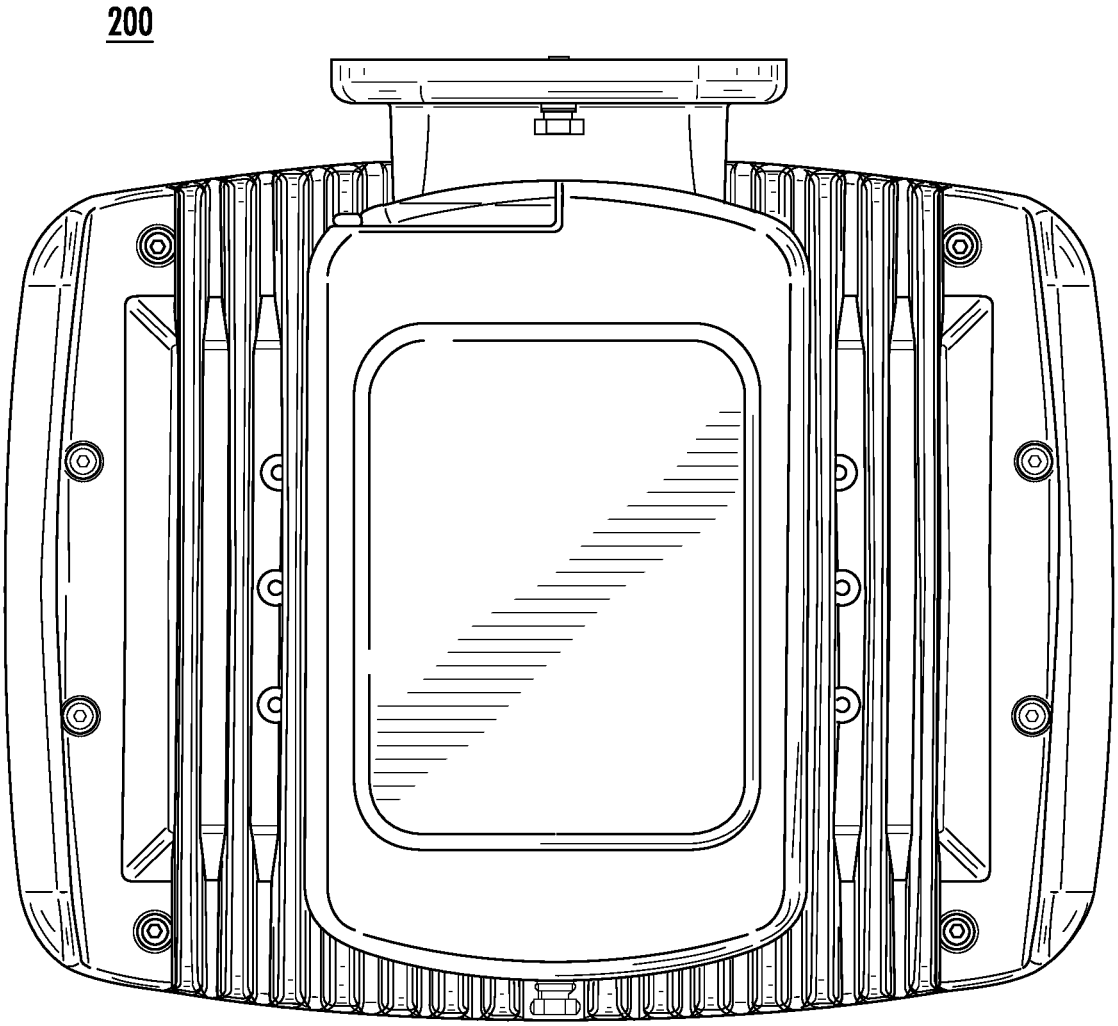
FIG. 6 is a top view of the luminaire with the wall pack of FIG. 4.

FIG. 6 is a top view of luminaire 200 with wall pack assembly 250 of FIG. 4.

Figure 7:
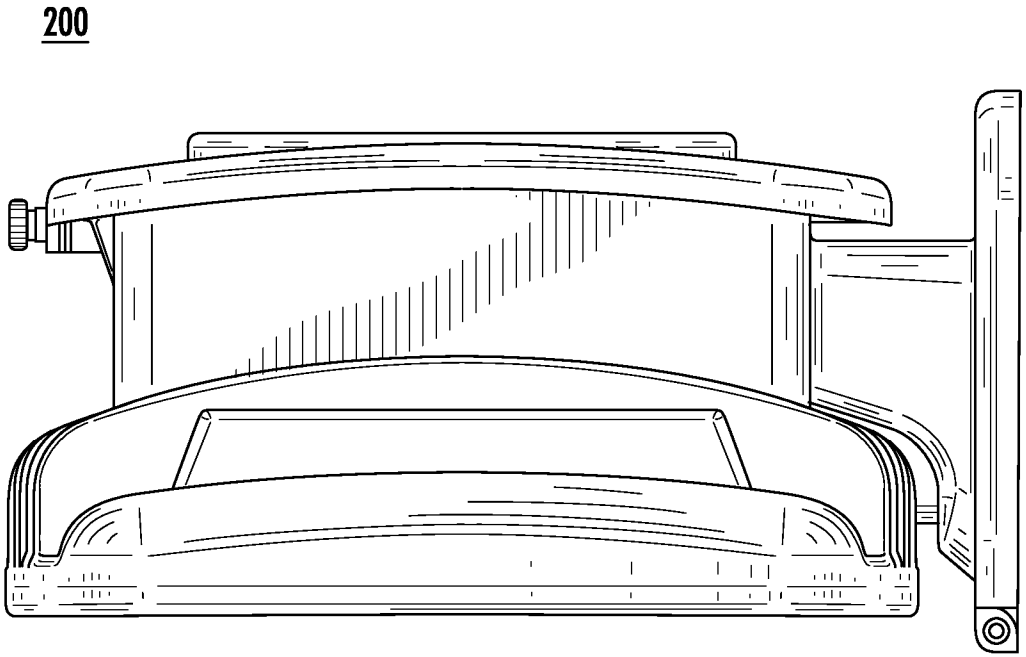
FIG. 7 is a side view of the luminaire with the wall pack of FIG. 4.

FIG. 7 is a side view of luminaire 200 with the wall pack assembly 250 of FIG. 4.

Figure 8:
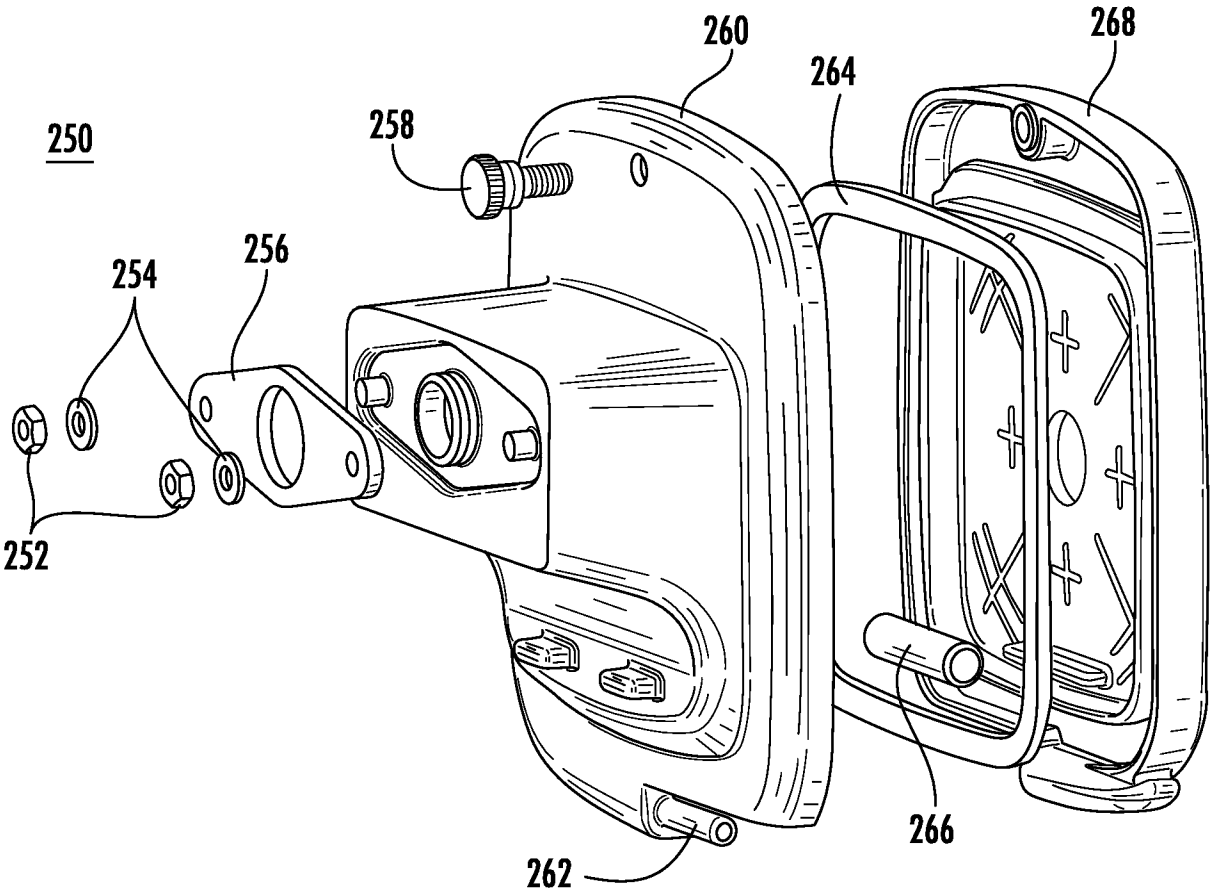
FIG. 8 is an exploded view of a wall pack in accordance with the present invention.

FIG. 8 is an exploded view of wall pack assembly 250 in accordance with the present invention. As shown in FIG. 8, wall pack assembly 250 generally comprises a locking nut(s) 252, a washer(s) 254, a first wall pack gasket 256 for attachment to an outer surface of front wall pack mounting bracket 260, a screw 258 (such as a locking thumbscrew), a mounting hinge pin 262, a second wall pack gasket 264 between front wall pack mounting bracket 260 and back wall pack mounting plate 268, and a level 266. As a feature of the invention, driver box 212, driver box lid 210, lens cover 242, front wall pack bracket 260, and back wall pack mounting plate 268 are made of the same material. An example of such material is a polycarbonate and polyethylene terephthalate (PET) blend. A commercially available example of such material is Bayer Makrolon EL703.

Figure 9:
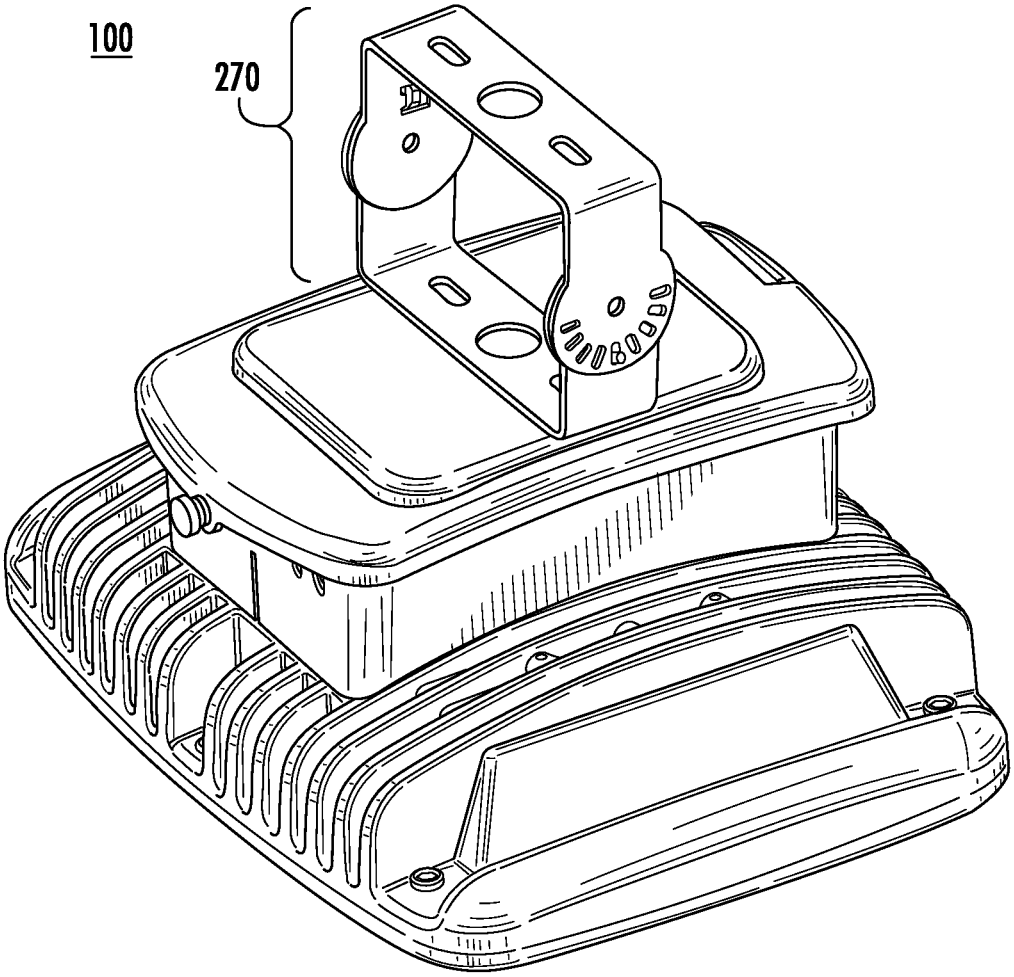
FIG. 9 is a perspective view of the luminaire of FIG. 1 with a trunnion mounting bracket in accordance with the present invention.
Figure 10:
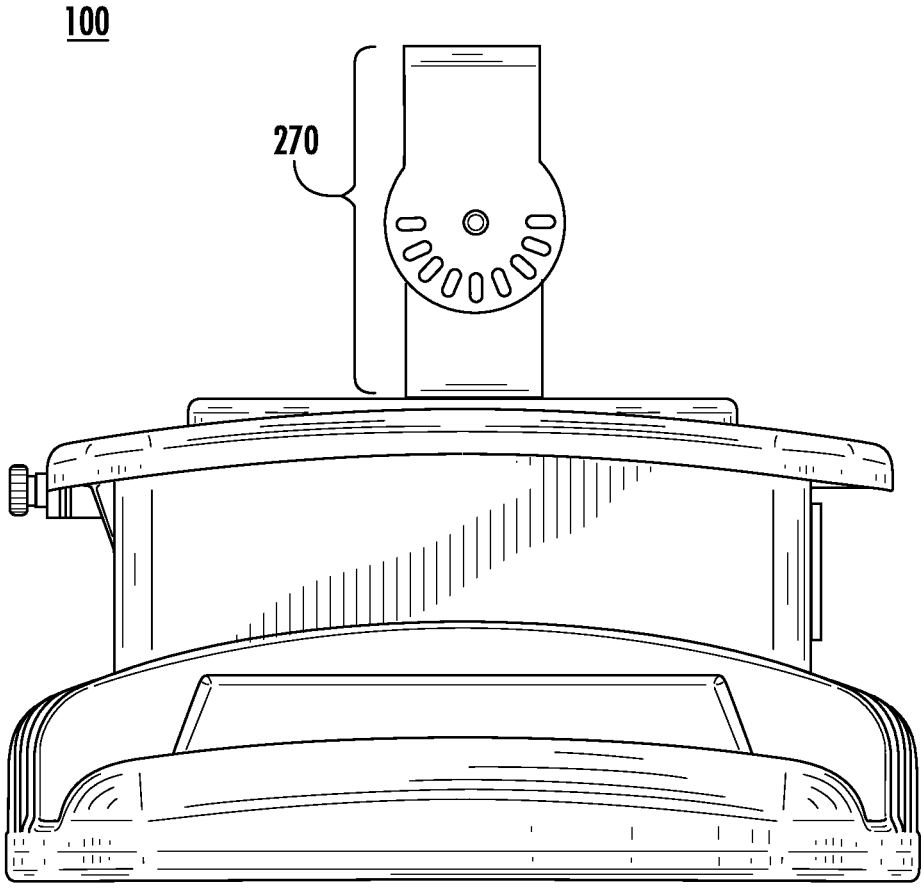
FIG. 10 is a side view of the luminaire with the trunnion mounting bracket of FIG. 9.
Figure 11:
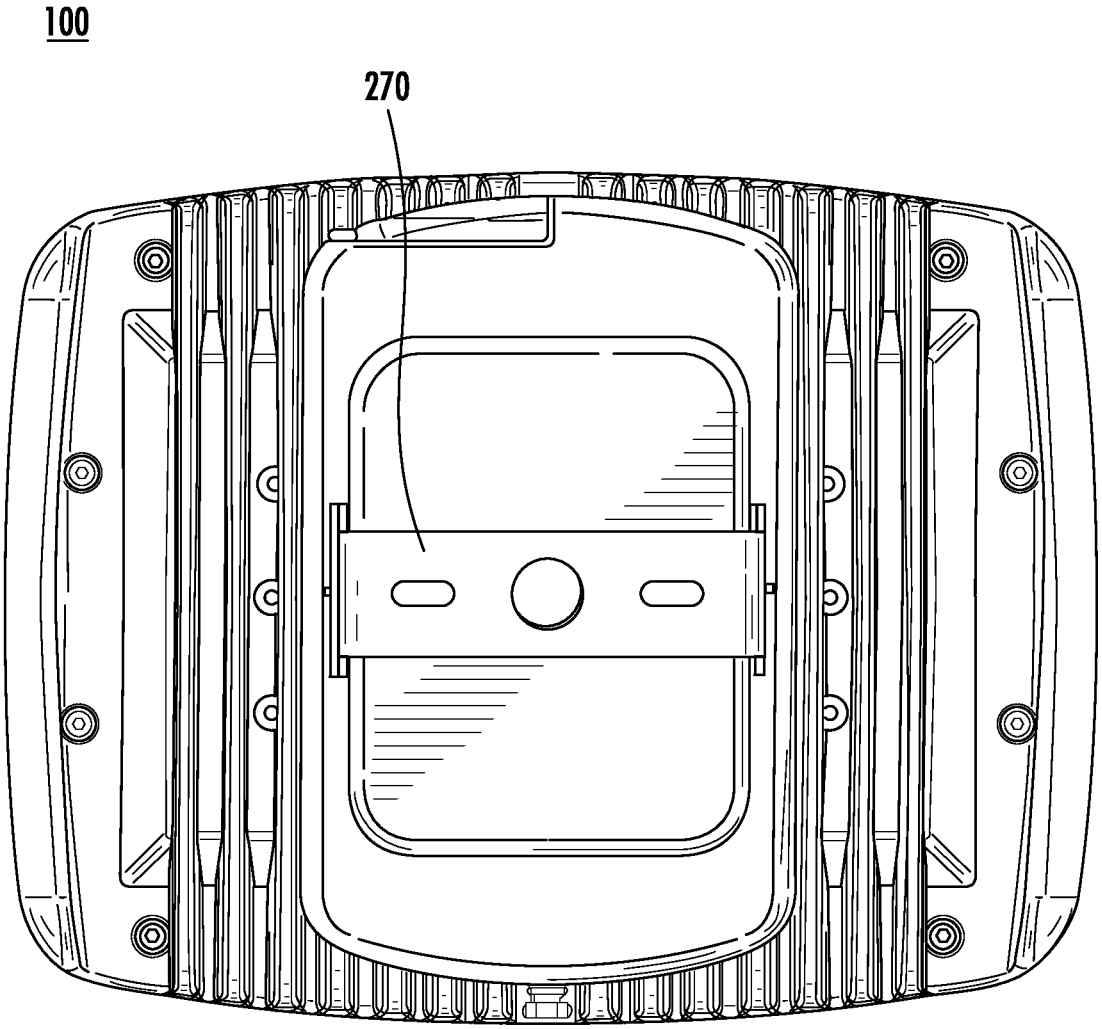
FIG. 11 is a top view of the luminaire with the trunnion mounting bracket of FIG. 9.
Figure 12:
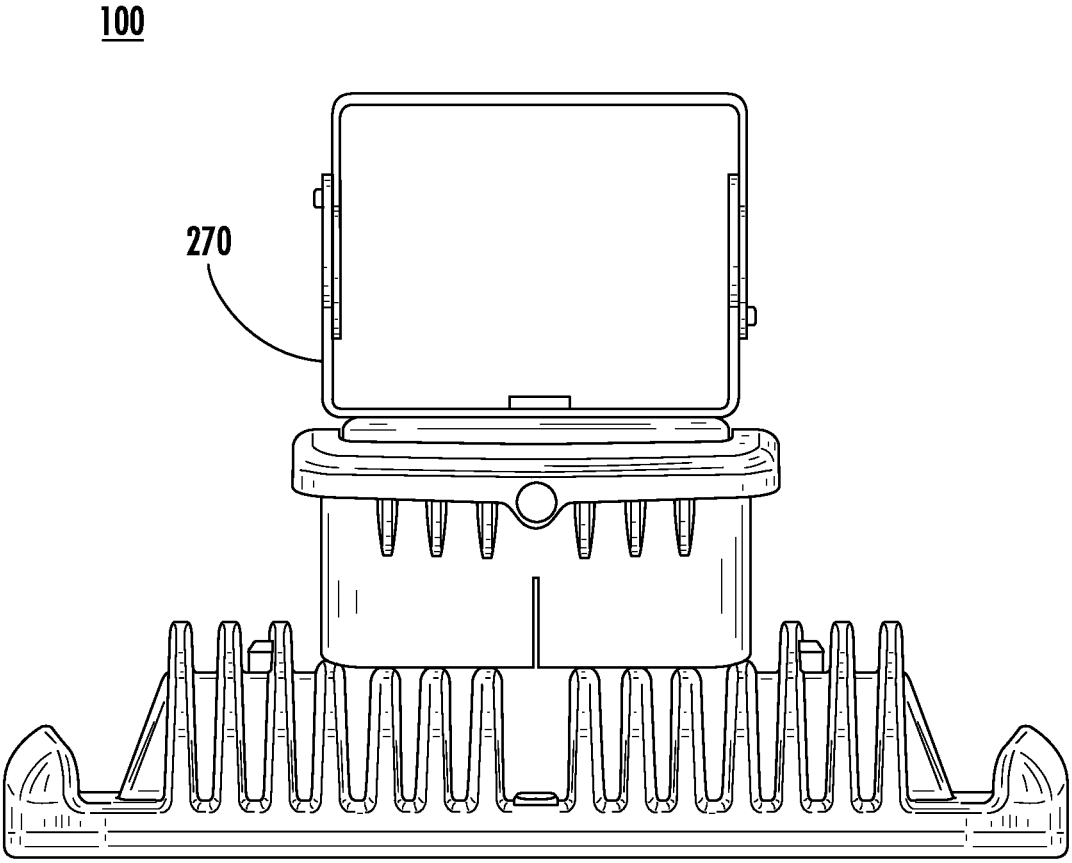
FIG. 12 is a front view of the luminaire with the trunnion mounting bracket of FIG. 9.

FIG. 9 is a perspective view of luminaire 100 with a trunnion mounting bracket 270 in accordance with the present invention. Trunnion mounting bracket 270 is attached or affixed to mounting plate 18. Preferably, trunnion mounting bracket 270 is adjustable. FIG. 10 is a side view of luminaire 100 with trunnion mounting bracket 270 of FIG. 9. FIG. 11 is a top view of luminaire 100 with trunnion mounting bracket 270 of FIG. 9. FIG. 12 is a front view of luminaire 100 with trunnion mounting bracket 270 of FIG. 9.

Figure 13:
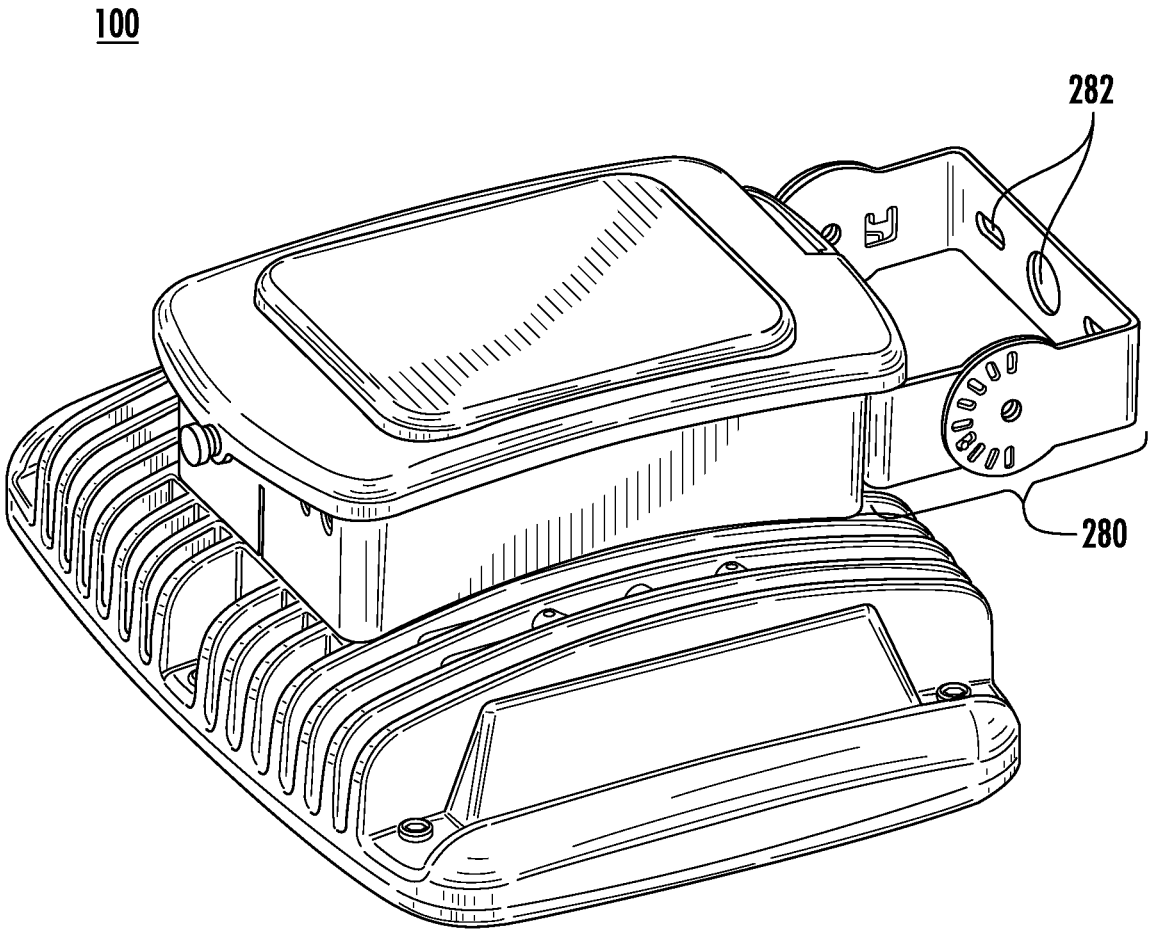
FIG. 13 is a perspective view of the luminaire of FIG. 1 with an adjustable wall pack or flood light assembly in accordance with the present invention.
Figure 14:
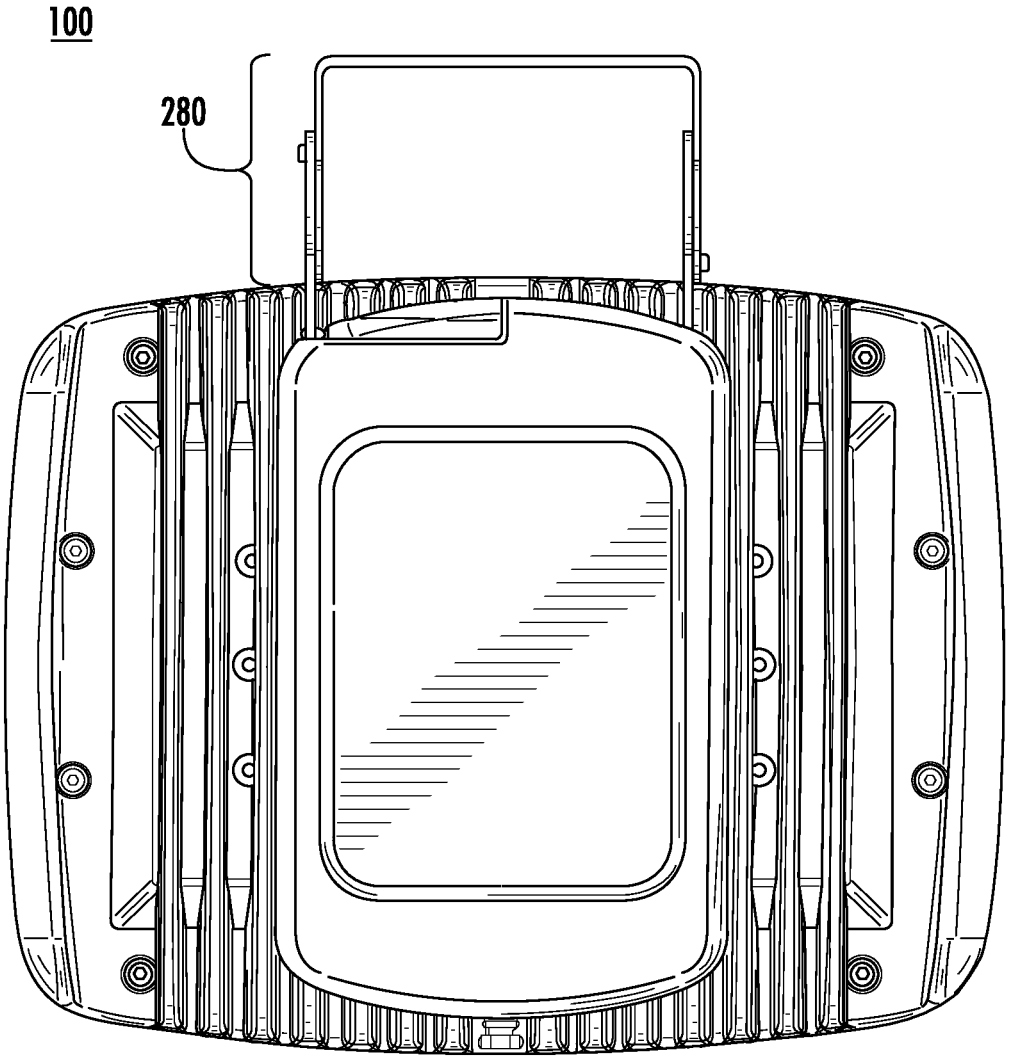
FIG. 14 is a top view of the luminaire of FIG. 1 with the adjustable wall pack or flood light assembly of FIG. 13.
Figure 15:
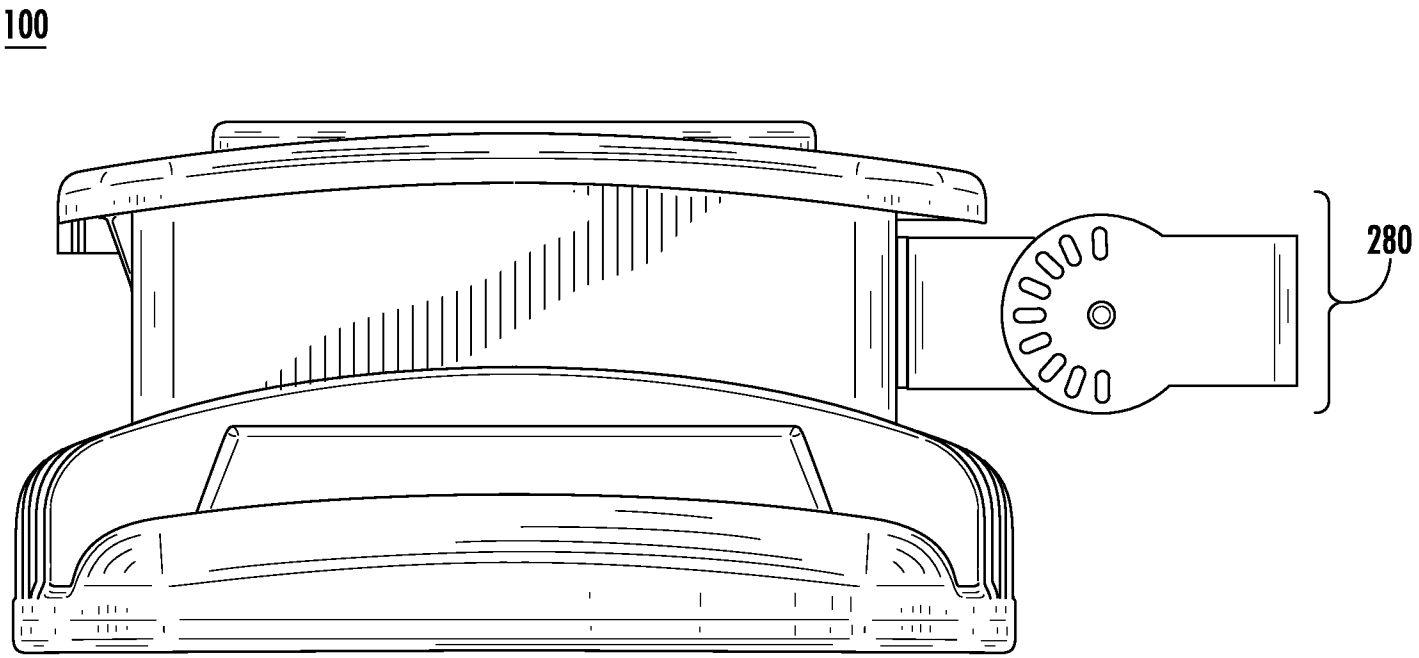
FIG. 15 is a side view of the luminaire of FIG. 1 with the adjustable wall pack or flood light assembly of FIG. 13.

FIG. 13 is a perspective view of luminaire 100 of FIG. 1 with an adjustable wall pack or flood light assembly 280 in accordance with the present invention. A wall pack is typically mounted onto a surface of a wall. A wall pack typically shines light downward or outward away from the wall. A flood light can be mounted on the ground, on a pole, or on any other surface to illuminate the subject with a flood of light. As shown in FIG. 13, adjustable wall pack or flood light assembly 280 has slots and/or holes 282 to provide multiple mounting options. FIG. 14 is a top view of luminaire 100 of FIG. 1 with adjustable wall pack or flood light assembly 280 of FIG. 13. FIG. 15 is a side view of luminaire 100 of FIG. 1 with adjustable wall pack or flood light assembly 280 of FIG. 13.

Figure 16:
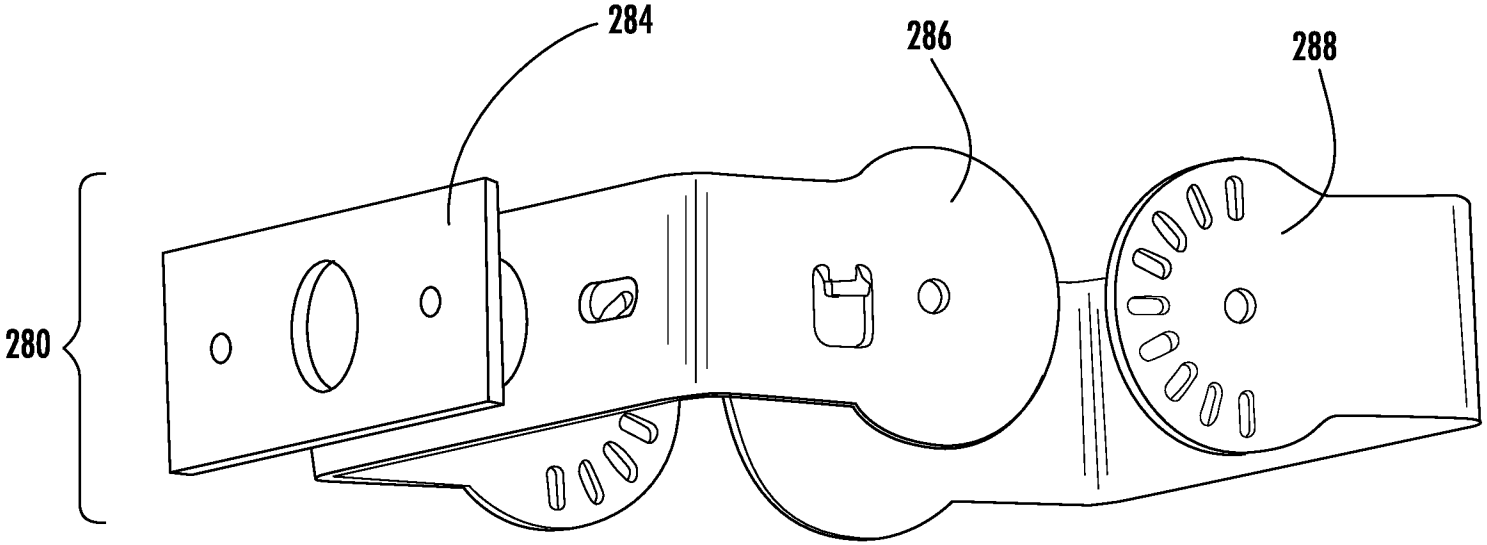
FIG. 16 is an exploded view of the adjustable wall pack or flood light assembly 280 of FIG. 13.

FIG. 16 is an exploded view of luminaire 100 of FIG. 1 with adjustable wall pack or flood light assembly 280. Adjustable wall pack or flood light assembly 280 generally comprises a gasket 284 for attachment with bolts (not shown) to driver box 12, a first rotating trunnion mounting bracket 286 for attachment to gasket 284, and a second rotating trunnion mounting bracket 288 for attachment to first rotating trunnion mounting bracket 286. As a preferred feature, first rotating trunnion mounting bracket 286 and second rotating trunnion mounting bracket 288 each are adjustable, multi-position rotating brackets.

Figure 17:
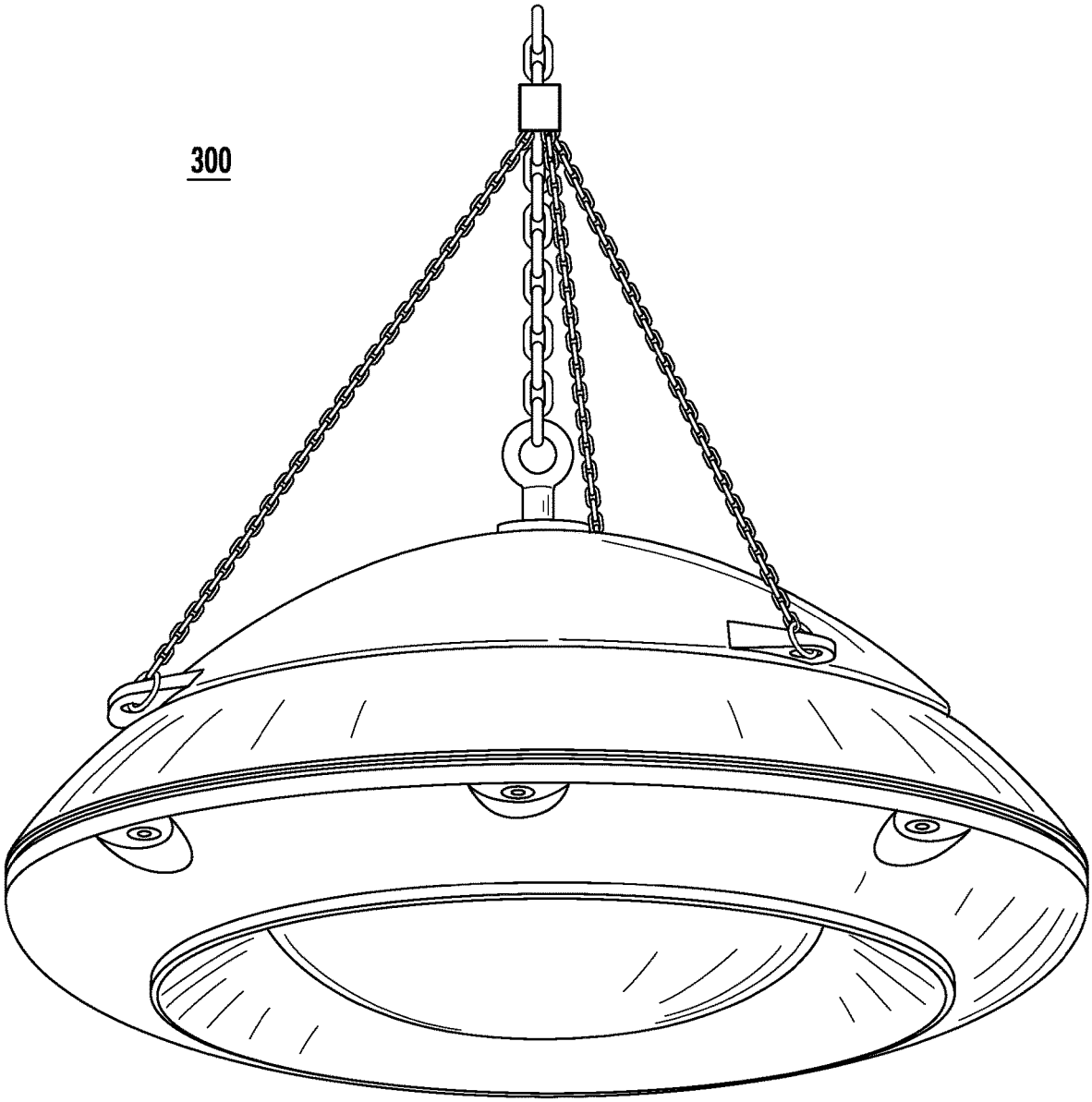
FIG. 17 is a perspective view of a luminaire having internal interlocking fins in accordance with the present invention.

In an embodiment of the present invention, a luminaire having internal interlocking fins is provided. FIG. 17 is a perspective view of luminaire 300 in accordance with the present invention.

Figure 18:
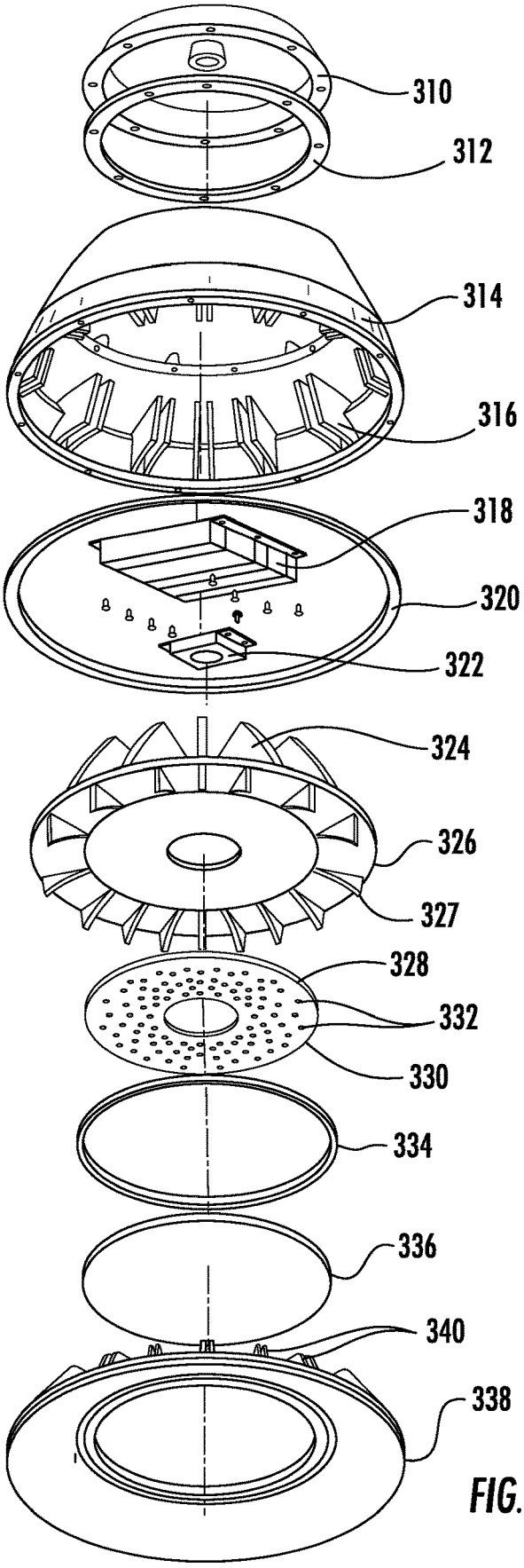
FIG. 18 is an exploded view of the luminaire having internal interlocking fins or ribs in accordance with the present invention.

FIG. 18 is an exploded view of luminaire 300 having internal interlocking fins (also referred to as ribs) in accordance with the present invention.

Much higher lumen output designs than 5,000 lumen and 10,000 lumen or more may be fabricated using a unique interface of the internal aluminum LED heat sink and the outer thermally conductive housing. This interface efficiently transfer the heat away from the aluminum heat sink fins to the mating internal fins of the outer thermally conductive plastic shell.

Another feature of the higher (10,000 lumen or more) lumen package luminaire is that it incorporates an interface between the aluminum heat sink and the outer housing. This interface is achieved by trapping the fins of the LED heat sink between adjoining fins on the inside of the housing. The use of a thermal interface material can be used to increase heat transfer and eliminate air gaps.

Another feature of the luminaire is the outer thermally conductive housing has internal fins that interface with LED heat sink fins.

As another feature, an outer shell for the luminaire is divided into a housing cover and a housing. The plastic that covers a driver and high voltage is a resin that is rated for UL1598 suitable for outdoor requirements which consists of the plastic being seasoned for 3 hours and then subjected to the impact test for polymeric enclosures (UL1598 Section 16.41). The housing is comprised of thermally conductive plastic resin that eliminates the need for external fins that are used for heat dissipation.

As shown in FIG. 18, luminaire 300 generally comprises a housing cover 310, a gasket 312 that seals a joint between housing cover 310 and housing 314, a housing 314 having internal housing fins 316, a driver(s) 318, a gasket 320 that seals a joint between housing 314 and lens cover 338, a sensor 322, a heat sink 326 having upward facing fins 324 and downward facing fins 327, a thermal interface material 328 on back of LED printed circuit board (pcb) 330, a LED 332 on LED printed circuit board 330, a gasket 334 for attachment to a lens 336, and lens cover 338 having upward facing lens cover fins 340 thereon. Housing cover 310, housing 314, and lens cover 338 are each preferably comprised of a thermally conductive plastic. Examples of thermally conductive plastic include, but are not limited to, polyvinyl chloride. (PVC) polyphenylene sulfide, polyamide (nylon), polycarbonate, Acrylonitrile-Butadiene-Styrene (ABS), Liquid Crystalline Polymer (LCP), thermoplastic elastomer, polyphthalamide, polybutylene terephthalate, and polyarylethereketone, and a combination thereof. Heat sink 326 is preferably comprised of die-cast aluminum.

Figure 19:
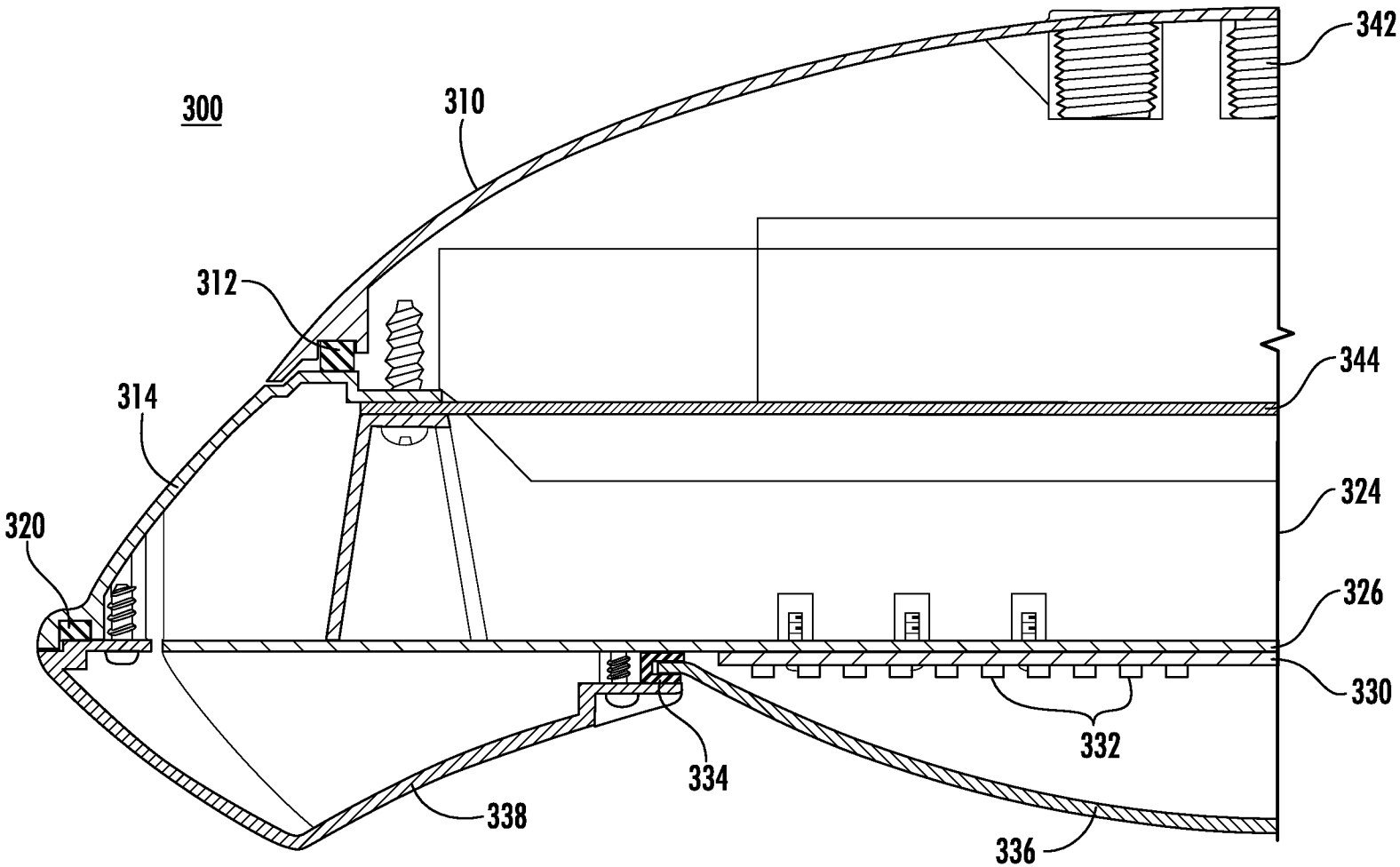
FIG. 19 is a partial cross-sectional view of the luminaire having internal interlocking fins in accordance with the present invention.

FIG. 19 is a partial cross-sectional view of luminaire 300. FIG. 19 illustrates housing cover 310, gasket 312, housing 314, molded in threads for mounting 342, gasket 320, driver 318, a driver mounting plate 344 (preferably aluminum), an emergency battery back-up 346, heat sink 326 (preferably cast aluminum), upward facing fin 324 (preferably cast aluminum), printed circuit board 330, LED 332, LED board mounting bosses 348, gasket 334 (preferably silicone), lens 336 (preferably polycarbonate), and lens cover 338.

Figure 20:
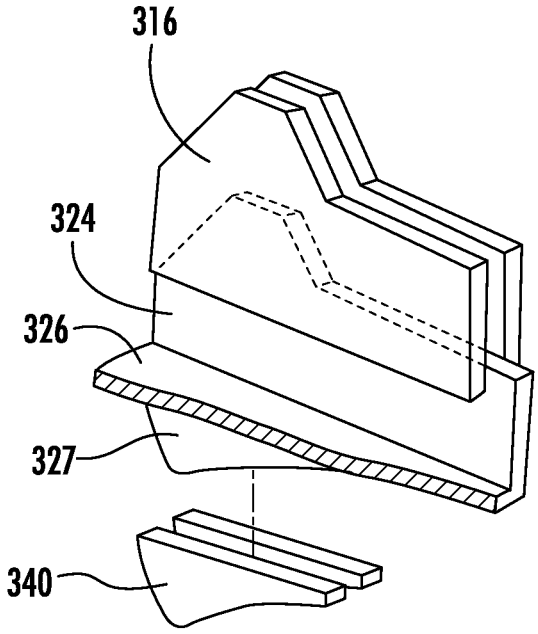
FIG. 20 is a perspective view of the interlocking fins of the luminaire in accordance with the present invention.

FIG. 20 is a perspective view of interlocking fins of luminaire 300 in accordance with the present invention. As shown in FIG. 20, fins 316 of housing 314 mate or interlock together with fins 324 of heat sink 326. Lens cover fins 340 of lens cover 338 mate or interlock together with fins 327 of heat sink 326. In a preferred embodiment, housing fins 316 come from a downward direction towards upward facing heat sink fins 324 and interlock with upward facing heat sink fins 324. In a preferred embodiment, lens cover fins 340 coming in an upward direction to mate or interlock with downward facing heat sink fins 327.

Figure 21:
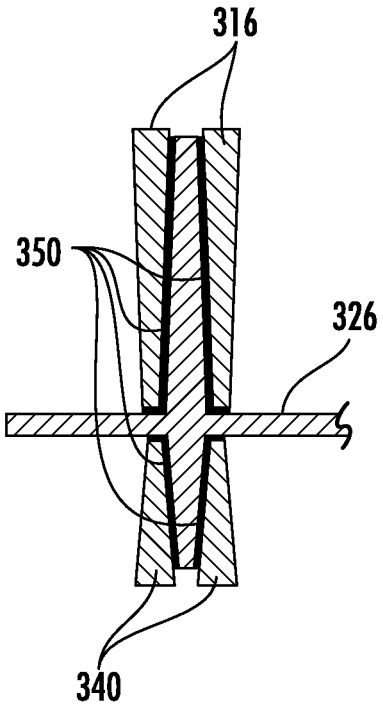
FIG. 21 is a cross-sectional side view of the interlocking fins of the luminaire in accordance with the present invention.

FIG. 21 is a cross-sectional side view of interlocking fins of luminaire 300 in accordance with the present invention. As seen in the cross-sectional view, a thermal interface material 350 fills any gaps between fins 316 and heat sink fins 324 and heat sink 326 as well as between lens cover fins 340 and heat sink fins 327 and heat sink 326. Examples of thermal interface materials include, but are not limited to, grease or thermal pads.

Among other features of the invention, luminaires 100, 200, and 300 provide for the use of secondary optics to offer different beam angle light patterns such as a 10° spot flood.

Luminaires 100, 200, and 300 are considered UL 844 Explosion proof in accordance with Underwriters' Laboratories (UL) 844 Class 1, Division 2 and Class 2, Divisions 1 and 2. Luminaires 100 and 200 are also suitable for use in hazardous locations or hazardous areas.

Luminaires 100, 200, and 300 are suitable for use in residential, industrial and commercial environments. Examples of industrial and commercial environments include, but are not limited to, food processing plants, industrial facilities, airports, outdoor lighting, marine facilities, cold storage/refrigeration, wash down areas, construction sites, waste water treatment plants, and natatoriums.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A luminaire comprising:

a housing having external heat sink fins located thereon, a driver box mounted on top of the housing, and at least one light-emitting diode printed circuit board having a light-emitting diode within the housing, wherein the housing is comprised of a thermally conductive plastic resin and the thermally conductive plastic resin comprises a base resin material and the base resin material is selected from the group consisting of polyvinyl chloride (PVC), polyphenylene sulfide, polyamide (nylon), polycarbonate, Acrylonitrile-Butadiene-Styrene (ABS), Liquid Crystalline Polymer (LCP), thermoplastic elastomer, polyphthalamide, polybutylene terephthalate, and polyaryletherketone, and a combination thereof, and wherein the luminaire has a luminaire output of at least 5000 lumen.

2. The luminaire according to claim 1, wherein the housing is a single molded housing.

3. The luminaire according to claim 1, wherein the luminaire further comprises a gasket between the driver box and the housing.

4. The luminaire according to claim 1, wherein the luminaire output is 10,000 plus lumen.

5. The luminaire according to claim 1, wherein the base resin material is polycarbonate.

6. The luminaire according to claim 1, wherein the thermally conductive plastic resin has a rating of at least 15 Watts per meter Kelvin in-plane.

7. The luminaire according to claim 1, wherein the luminaire is classified for UL hazardous locations.

8. The luminaire according to claim 3, wherein the gasket has a minimum of 3/16 inch of flat contact area.

9. The luminaire according to claim 1, wherein the housing further comprises a lens comprised of polycarbonate.

10. The luminaire according to claim 1, wherein the luminaire is an area light, wall pack light, or flood light.

11. The luminaire according to claim 1, wherein the light-emitting diode printed circuit board is mounted on an aluminum heat dissipation plate within the housing.

12. A luminaire comprising:

a housing having fins located within the housing, a driver box mounted within the housing, a heat sink having upward facing and downward facing heat sink fins within the housing, at least one light-emitting diode printed circuit board having a light-emitting diode within the housing, a lens within the housing, and a lens cover attached to the housing, the lens cover having lens cover fins interlocking with the downward facing heat sink fins of the heat sink, wherein the upward facing heat sink fins are interlocking with the housing fins of the housing, and wherein the housing is comprised of a thermally conductive plastic resin.

13. The luminaire according to claim 12, wherein the thermally conductive plastic resin comprises a base resin material.

14. The luminaire according to claim 13, wherein the base resin material is selected from the group consisting of polyvinyl chloride (PVC), polyphenylene sulfide, polyamide (nylon), polycarbonate, Acrylonitrile-Butadiene-Styrene (ABS), Liquid Crystalline Polymer (LCP), thermoplastic elastomer, polyphthalamide, polybutylene terephthalate, and polyaryletherketone, and a combination thereof.

15. A luminaire comprising:

a housing having external heat sink fins located thereon, a driver box mounted on top of the housing, and at least one light-emitting diode printed circuit board having a light-emitting diode within the housing, wherein the luminaire is waterproof and the luminaire further comprises a gasket between the driver box and the housing and wherein the housing is a single molded housing, and the driver box is electrically connected with the light-emitting diode of the at least one light-emitting diode printed circuit board.

* * * * *